United States Patent [19]

Hill et al.

[11] Patent Number: 4,811,800

[45] Date of Patent: Mar. 14, 1989

[54] FLEXIBLE DRILL STRING MEMBER ESPECIALLY FOR USE IN DIRECTIONAL DRILLING

[75] Inventors: Guy J. Hill, Friendswood; Homer G. Smith, Jr., Houston; Mark W. Schnitker, Missouri City; Glenn E. Beatty, Houston, all of Tex.

[73] Assignee: Homco International Inc., Bellaire, Tex.

[21] Appl. No.: 111,222

[22] Filed: Oct. 22, 1987

[51] Int. Cl.[4] ..... E21B 17/22; B23P 21/00

[52] U.S. Cl. ..... 175/323; 138/118; 464/18; 29/469

[58] Field of Search ..... 175/61, 323; 464/18, 464/20; 138/118, 118.1, 120, 122, DIG. 5; 29/469

[56] References Cited

U.S. PATENT DOCUMENTS

| | | | |
|---|---|---|---|
| 2,460,657 | 2/1949 | Robinson | 72/53 |
| 2,999,552 | 9/1961 | Fox | 175/323 |
| 3,125,173 | 3/1964 | Fox | 175/323 |
| 3,194,331 | 7/1965 | Arnold | 175/323 |
| 3,360,960 | 1/1968 | Massey | 175/323 |
| 3,554,307 | 1/1971 | Yount | 175/323 |
| 4,365,678 | 12/1982 | Fitch | 175/323 |
| 4,443,762 | 4/1984 | Kuckes | 175/45 X |
| 4,460,202 | 7/1984 | Chance et al. | 175/323 X |

*Primary Examiner*—Bruce M. Kisliuk

*Attorney, Agent, or Firm*—Edward J. Cabic

[57] ABSTRACT

The invention relates to an improved drill string member having at least one spiral groove formed in its outside surface and incorporating a combination of engineering considerations and criteria such that the invention member will have an extraordinarily high performance capacity in directional drilling. The invention member can make bends in the well on radii as short as 25–50 feet and is particularly suitable for operation together with downhole motor driven bits.

14 Claims, 8 Drawing Sheets

FIG. 5
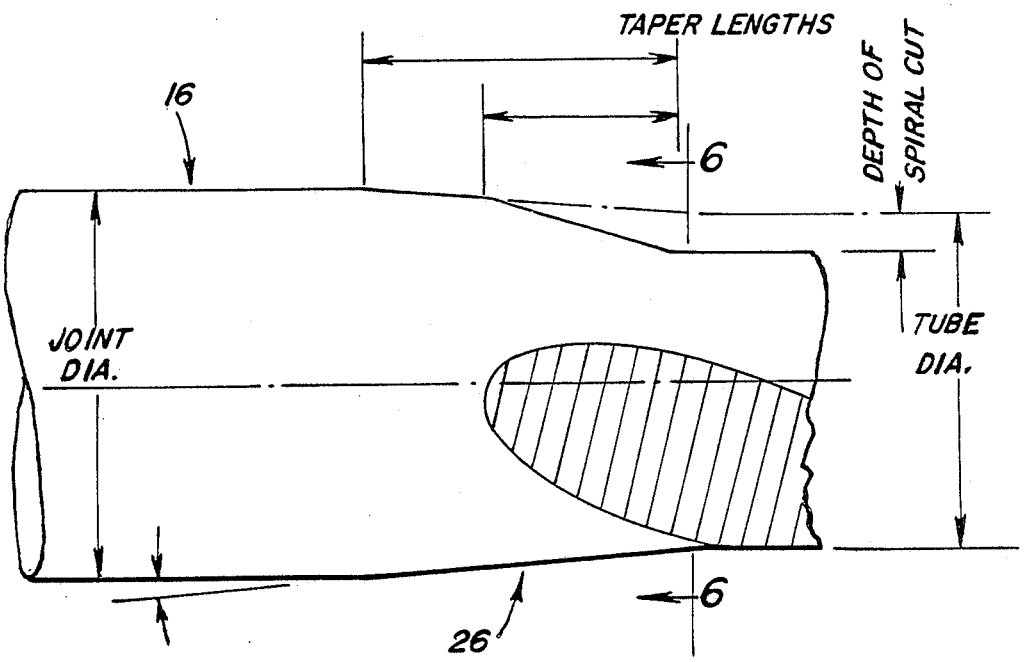
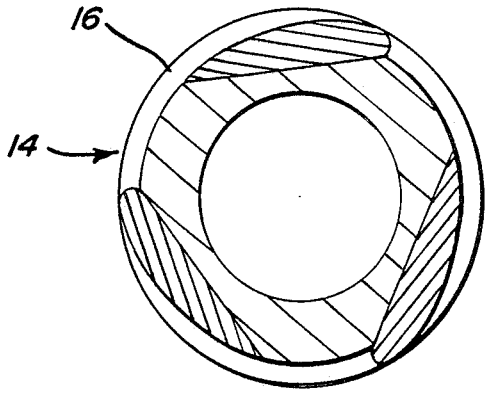
FIG. 6

AVERAGE PERCENTAGE OF SPIRAL DEPTH VS. WALL THICKNESS

| | | |
|---|---|---|
| DRILL PIPE | — | 0% |
| DRILL COLLAR | — | 8 – 22% |
| U.S.P. 4,460,202 | — | 35 – 40% |
| INVENTION | -- | |
| RANGE DESIRED FOR INVENTION | — | 55 – 85% |

FIG. 11 BEND RADIUS VS. PERCENT OF YIELD
CONSTANT O.D. FOR ALL MEMBERS
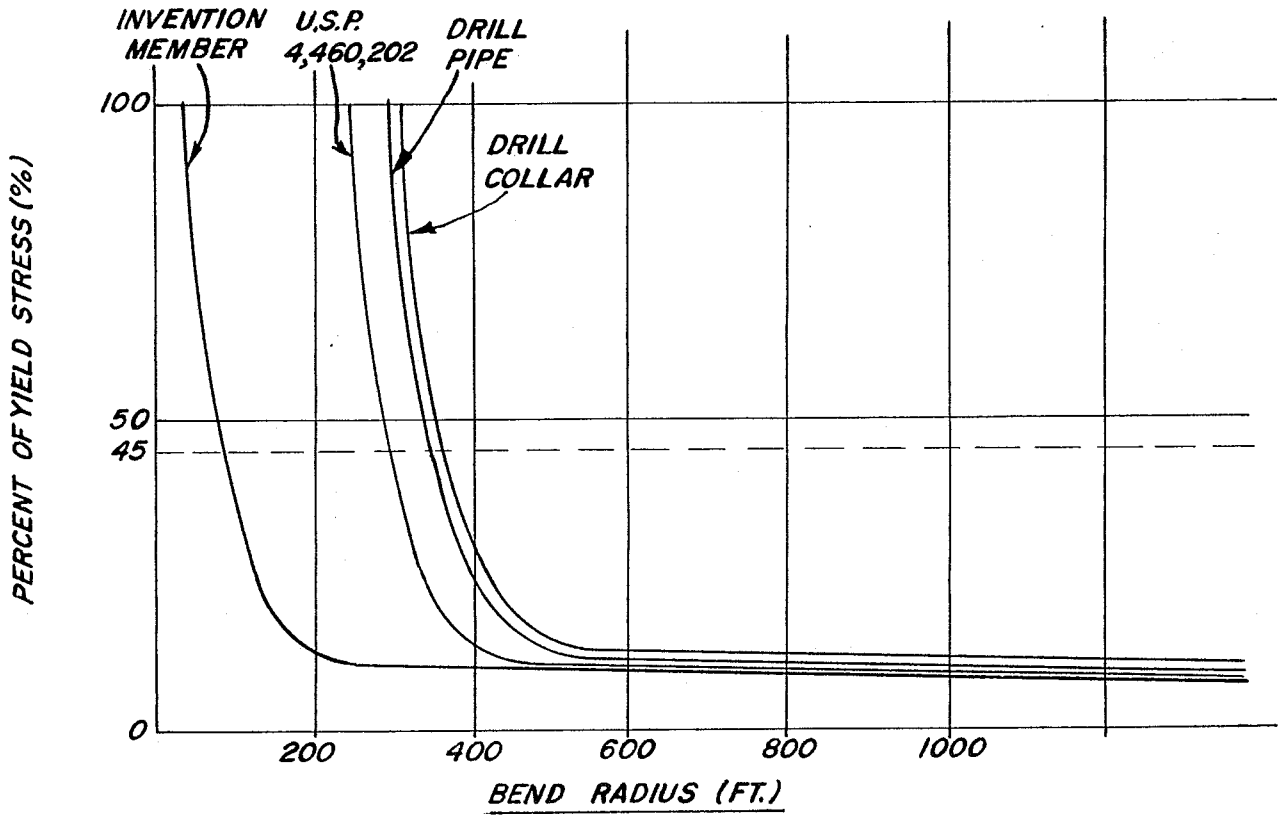

FLEXIABLE DRILL STRING MEMBER ESPECIALLY FOR USE IN DIRECTIONAL DRILLING

FIELD OF THE INVENTION

This invention relates to the drilling of hydrocarbon wells, and in particular it pertains to the newer area in this field of drilling wells having horizontal portions or having portions which are at substantial angles off of the vertical. Petroleum engineers have used these wells in order to hold down costs, because the particular reservoir conditions require it, in offshore applications where one drilling and production platform is used to develop a large area, and in other situations.

PRIOR ART AND BACKGROUND OF THE INVENTION

The invention is applicable primarily to the field of directional or deviated drilling. More in particular, the invention is, therefore, also applicable for use with downhole motors as used in such techniques. These fields, that is, directional drilling and downhole motors, are well developed each in its own right, and thus form part of the invention as to its application, but not part of the invention per se.

More specifically, the present invention concerns a drill string member which makes the bends from the beginning of the well which is vertical, to the horizontal or highly deviated portions thereof. There are known prior art drill members and techniques for accomplishing this, but all of these techniques have numerous disadvantages which are overcome by the present invention. Among the disadvantages are that it has not been known heretofore to make such bends on relatively short radii without using highly specialized and expensive equipment. Conventional drilling and deviated drilling both depend upon lengthening the drill string by adding joints of pipe at the surface. Because of the greatly increased stresses on the drill pipe in directional drilling tending to shorten its life, such bends in prior art drilling techniques have always been made on relatively long radii producing relatively gentle bends. These bends are "expensive" in terms of drilling time and equipment, are not easy to control, and have many other disadvantages well known to those skilled in these arts.

Thus, the present invention provides a relatively limber drill string member particularly adapted for use with but not limited to down hole motors and with measurement while drilling (MWD) techniques. The invention permits the maximum utilization of the advantages of directional drilling and MWD techniques in a highly efficient manner, at relatively low cost, permits making the bends in the borehole on very short radii, while at the same time overcoming all of the disadvantages of the prior art.

SUMMARY OF ADVANTAGES OF THE INVENTION

The invention drill string member uses spiraling on its outside surface. This idea, in general only, is well known in the art; see, for example, prior U.S. Pat. No. 2,999,552 to Fox, and U.S. Pat. No. 4,460,202 prior U.S. Pat. No. 2,999,552 to Fox, and U.S. Pat. No. 4,460,202 to Chance and Kovensky (owned in common with the present invention). However, spiraling is used in the invention in new ways and with new thinking, as discussed more in detail below.

Further, due to the relatively large depth of the spiral grooving in the invention, at least 40% of the wall thickness of the body measured from the land O.D. to the member's I.D., and preferably in the range of 55% to 85% thereof; and due to other factors, member made in accordance with the invention fit into a special weight niche between drill collars, heavy weight drill members, the member of Chance and Kovensky U.S. Pat. No. 4,460,202, and drill pipe. The invention at the same time maintains the advantages of both drill pipe and drill collars in that it can operate while containing substantial internal pressure from the drilling mud, and in tension, in compression, in torsion, in bending, and in combinations of all of these forces as are demanded by the rigors of directional drilling which are very demanding as to the performance of the drill string.

Because of the spiral grooving, the invention shares the beneficial effects of that feature with the prior art, and in some cases enhances those advantages. The spiral grooving tends to insure that no one area at the surface of the invention member will be in contact with the borehole in a manner differentially with respect to any other such area. This means that the drill string member of the invention does not tend to stick to the borehole. Another advantage is that the spiraling, which is preferably right-handed, in effect "screws" the bit down into the "bottom" of the hole, whether this bottom is vertically or horizontally aligned at the moment. This "screwing down" effect is particularly important in the environment of the invention of directional drilling, since the normal pressure on the bit created by the weight of the drill string is minimized when the drill string is deviated from vertical, and is especially so when the borehole is horizontal in orientation.

Yet another advantage of the invention is that the spiraling tends to churn the drilling mud which further enhances the efficiency of the drilling operation overall. Again, this is especially important in deviated and horizontal holes because gravity tends to force the mud and the entrained drill cuttings to collect at the bottom of the hole, which aggravates the problem even further unless the mud is kept churned and moving out of the hole.

A related advantage is that the churning tends to keep a uniformly thick mud cake of the borehole wall thereby preventing contaminants from extruding into the producing formations.

The underlying engineering supporting the invention drill string member is based on an approach considerably different from that used in the design and building of conventional drill string members. Because of the substantial expense involved in conventional drill string members, especially the larger, heavier ones such as drill collars and heavy weight drill pipe, these members are designed for repeated reuse, and thus they are made of relatively thick walls and are generally heavy and strong. One can expect reuse of a conventional drill collar perhaps as many as 30 or 40 or more times, and this is highly economical in the prior art. However, such conventional members are also very stiff, exactly the opposite of the limber quality needed of drill string members for use in directional drilling.

The approach of the invention is to design the drill string member so that it will perform at the maximum limits of its mechanical properties. Reuse is "traded" as it were for limberness. That is, it is anticipated that members embodying the invention will be reused perhaps 6 or 8 or 10 or so times, and perhaps even fewer times for certain bend radii. These invention members will, however, be able to perform much better as to bending, making tighter radii, and the like. Members embodying the invention have no slip or elevator areas as are commonly found in other conventional drill string members. Further, the tool joints are short compared with new conventional drill string member, since repeated refinishing of the tool joints is not required because only limited reuse is anticipated.

Looking at this another way, the teaching of the invention is that it is desirable to remove an optimum amount of metal in the spiral groove area; at least 40% of the wall thickness of the body measured from the land O.D. to the member's I.D., and preferably in the range of 55% to 85% thereof; so as to provide an adequate stress balance between the land and the groove to thereby provide an acceptable useful life of the invention member as so grooved. this is another aspect of the discussion above concerning design to the maximum limits. It is totally contrary to the engineering principles applied to the design and manufacture of conventional drill string members. Prior art drill string members have large safety factors and much "overkill," i.e. they are designed to be heavy, strong, rigid, and for much reuse, and using, as a general rule, more rather than less metal in every part thereof.

The absence of the slip and elevator areas permits a gentle "feathering" of the spiral grooves into the tool joint areas, which prolongs the life of the invention member by more evenly spreading the stresses and strains throughout the drill string member rather than concentrating them as would occur in a slip or elevator area.

As discussed above, in directional drilling, the drill string member, including the invention drill string member, is subjected to all of the possible kinds of cyclic stresses, tension, compression, torsion, and bending. When going around a bend, the drill string members are subject to all of these forces simultaneously. It has been found that it is the cyclic bending tensile stress primarily that eventually causes failure. The teaching of the invention requires that the grooving be done to as great a depth as possible while still achieving a useful life, i.e., at least 40% of the wall thickness of the body measured from the land O.D. to the member's I.D., and preferably in the range of 55% to 85% thereof.

An optional feature of the invention is to subject the grooves to a compressive prestress, which causes the life of the drill string member at the bottoms of the spiral grooves to roughly equal that of the invention drill string member in the lands. This optional feature can be put on to the grooves by shot peening, carburization, or other well-known techniques.

Another important aspect of the invention is that it is fully compatible with the entire prior art of conventional drilling technology, including rigs, conventional drill string members of all sorts with which the invention can be used, directional drilling techniques, and MWD techniques. This is a significant advantage for the invention. Many other proposed improvements in drilling technology require completely new or at least very substantial revision of conventional technology. This is difficult and expensive to implement, creates resistance on the part of people in the field who are comfortable with proven technology, and thus reluctant to scrap the entire present system, and the like. All of the disadvantages are overcome or are not even present with the present invention in that it is fully compatible with existing technology.

Not only is the invention compatible with such technology, but it also can cooperate therewith in order to get the best advantage out of both the invention and the prior technology. For example, when a downhole motor driven bit is going around a bend, its technology requires that there may or may not be rotary motion of the drill string. Where there is no such rotation, this is an additional advantage for the invention drill string member in that it is not subjected to extra cyclic rotational stresses at that time, but only bending stresses. Likewise, downhole motors require that the drill string rotate while the downhole motor driven bit is drilling in a straight line, regardless of the orientation of the straight line (vertical, horizontal, or anywhere in between). However, for use in the invention, the drill string can rotate as slowly as the rig at the surface can rotate it. Thus, here again, there is a cooperative effect since the slower the drill string is rotated the smaller the number of cycles of life extracted from the invention drill string member.

Another factor of this cooperative effect is that the invention lends itself to use with drill string member made of nonferrous metals. MWD techniques require that the first few lengths of the drill string next to the bit be non-ferrous so that formation data can be gathered, and so that the data produced by the MWD tool can be transmitted clearly back to the surface in order to control the downhole motor. The invention provides an option in this respect; i.e., invention members can be made of non-ferrous metal.

Thus, it can be seen that the invention not only cooperates with but there is also a synergistic effect between conventional technology and the invention's teaching to achieve maximum efficiency overall and to enhance the advantages of both.

Mud cake can be a serious problem in drilling, and it can be an especially serious one in deviated and horizontal holes. Drilling mud is a viscous fluid pumped through the well for lubrication, to carry drilling chips up to the surface, and for downhole motors it acts as a power transmitting medium. This mud tends to collect in the hole, and it can increase friction, weight, and generally have a detrimental effect on the efficiency of the drilling operation overall if it is permitted to cake up. In fact, at the extreme, mud caking can cause sticking of the drill pipe, which is a very expensive problem to overcome. All spiral drill string members have some effect at churning the mud to prevent cake buildup. However, the present invention enhances this inherent advantage of spiral drill string members because the relatively large amount of grooved area produces a correspondingly small amount of land area. Thus, there is more room for the mud to move around the drill string, and the churning effect is generally enhanced. With less land touching the wall, there is more groove area within which the churned mud can move, and thus the efficiency of churning is increased.

A similar advantage has to do with differential sticking. Differential sticking is a phenomenon created by the pressure on one side of the pipe being different from the pressure on the other side, which difference in pressure can cause the pipe to stick to the wall of the well, and in the case of deviated or horizontal runs, to stick to the underside with respect to gravity. In the present invention, in common with other spiral drill members, this disadvantage is overcome in an improved manner, because the relatively large total area of groove allows the hydrostatic force to get underneath the invention member in a more efficient manner than is the case with other spiral drill string members. Thus, the invention improves the inherent beneficial effect as to differential sticking present in all spiral drill string members.

Thus, overall as to these two features, the efficiency of removing the cuttings is enhanced, the pump has to expend less energy to pump out the same amount of well cuttings, the torque required to turn the drill string is reduced, the drag is reduced, and overall, the efficiency of the drilling operation is improved due to the presence of the invention drill string member in the drill string.

While the invention was developed for and in the environment of a drill string member for use in well drilling, it is not limited in that fashion. For example, the invention technology could be used in a shock sub, a device put at the end of the drill string between the drill string and the drilling bit used to dampen the shocks to which the bit is subject when drilling hard or irregular formations. This would be in the environment of conventional rotary drilling as well as the invention's primary environment of highly deviated or directional drilling using downhole motor driven bits.

Totally outside the realm of the oil field, the invention can be used in other areas, such as the fabrication of a torsion bar for use in vehicles, such as automobiles, trucks, or railroad vehicles.

Thus, the invention provides a spiraled intermediate weight drill string member designed for directional and horizontal drilling, which is highly tolerant of tension, compression, bending, torsion, internal pressure from the drilling fluid, and the like in use. The invention member is designed to perform at the maximum of its properties and in a highly improved manner, but for a reduced number of endurance cycles. This combination of features is particularly adapted for the directional drilling environment. Looking at it another way, the invention drill string member has tensile qualities approaching those of a heavy walled drill pipe, while simultaneously having flexibility qualities better than those of a thin walled tube.

Accordingly, there is provided according to the invention an improved drill string member overcoming numerous disadvantages in the prior art, particularly adapted to the rigors of directional drilling, particularly suited to the engineering demands of that environment, fully able to cooperate with all conventional oil field drilling techniques, procedures, and equipment presently in use, and which is still highly advantageous and practical for its intended use.

The above and other advantages of the invention will be pointed out or will become evident in the following detailed description and claims, and in the accompanying drawing, also forming a part of this disclosure, in which:

BRIEF DESCRIPTION OF THE FIGURES OF THE DRAWING

FIG. 5 is an enlarged sectional view of the juncture between the main body portion of the invention member and its tool joint end showing the manner of feathering of the spiral grooves into the tool joint end;

FIG. 6 is a cross-sectional view taken on line 6—6 of FIG. 5;

FIGS. 8–11 are curves useful in understanding the engineering concepts and considerations utilized in the invention drill string member.

DETAILED DESCRIPTION OF THE PREFERRED EMBODIMENTS

Figure 1:
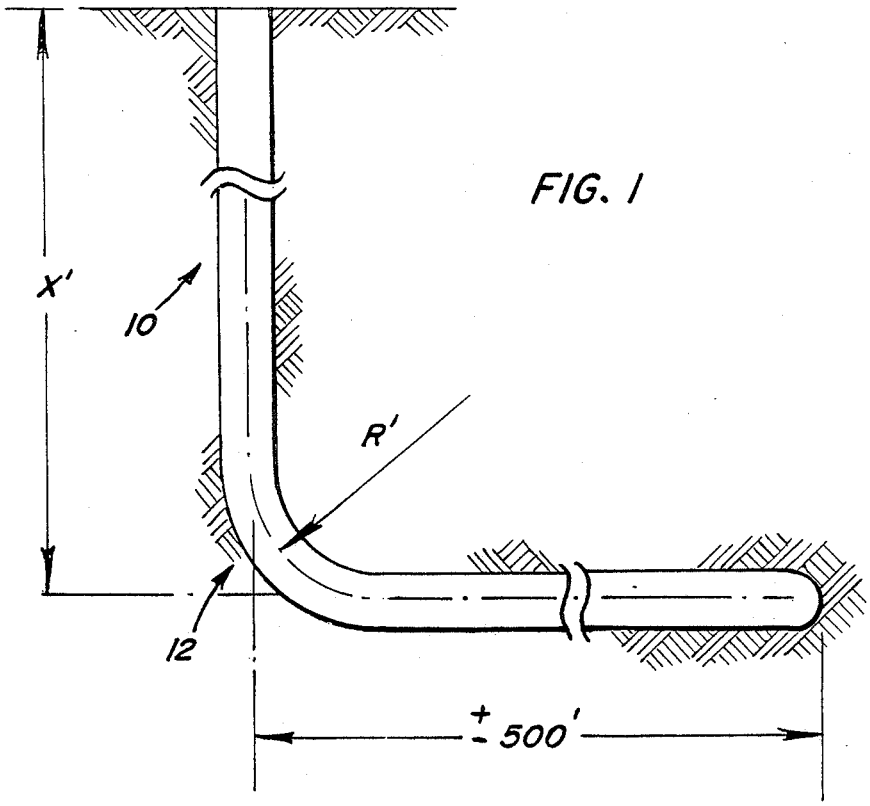
FIG. 1 is a side elevational view through a section of the earth showing the kind of borehole the invention is particularly well adapted to drill.

Referring now to FIG. 1, there is shown a well or borehole 10 having a bend 12 therein at a right angle, and defined by a radius R'. FIG. 1 shows the most severe case of a deviated well, that is, where the well is made up of a vertical section having a length X' and a horizontal section on the order of 500 feet or more. Of course, the invention could be used to drill wells wherein the bend 12 is more than 90 degrees, for example, 120 degrees.

In the present technology of deviated drilling, the radius R' is usually on the order of 500 feet. It is anticipated that the present invention will be able to make such bends on radii in the range of 50–100 feet, and it is anticipated that with further development of the invention even sharper bends on radii on the order of 25–50 feet will be possible.

For bends in the range of 100–500 feet, present technology is in a "gray" area. Beyond 500 feet, present technology will be more economical to use than that of the present invention. Thus, the logical range and area of operation for the present invention is all radii less than 500 feet, and radii as short as 25 feet are anticipated.

Figure 2:
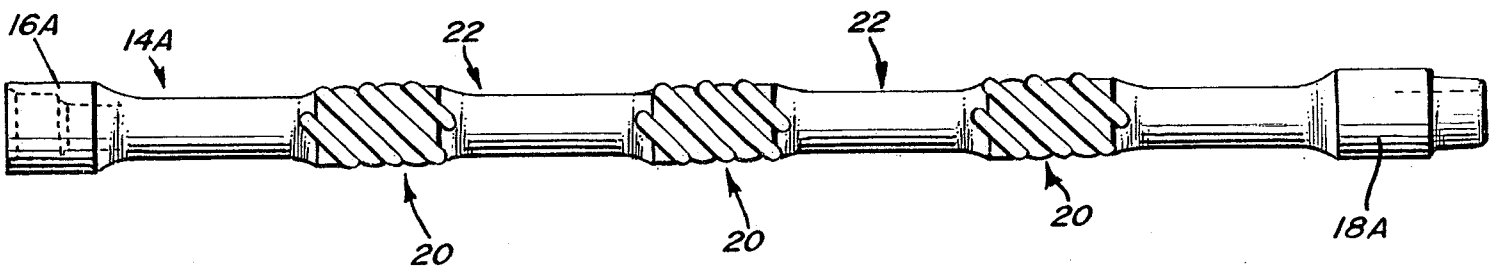
FIG. 2 is a side elevational view of a drill string member which was built during the development of the present invention.
Figure 3:
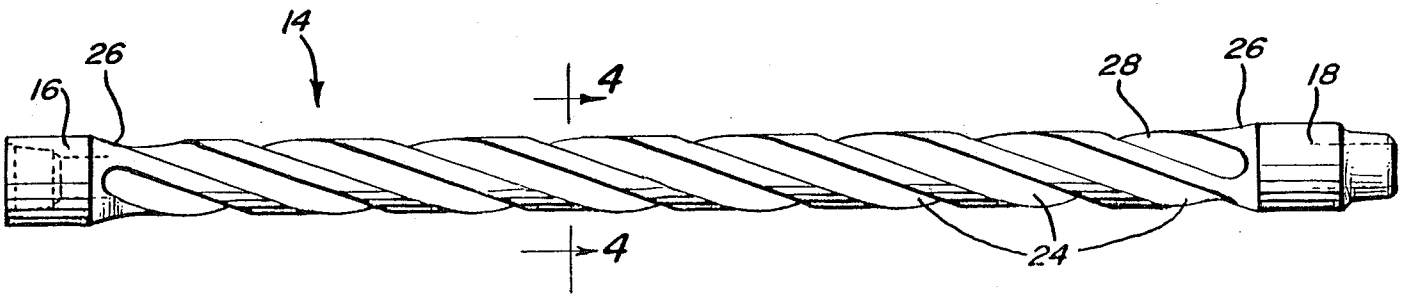
FIG. 3 is a view similar to FIG. 2 showing the invention member.

Referring now to FIGS. 2 and 3, there are shown two drill string members which are similar to each other, except for the manner in which the spiraling is provided.

Figure 4:
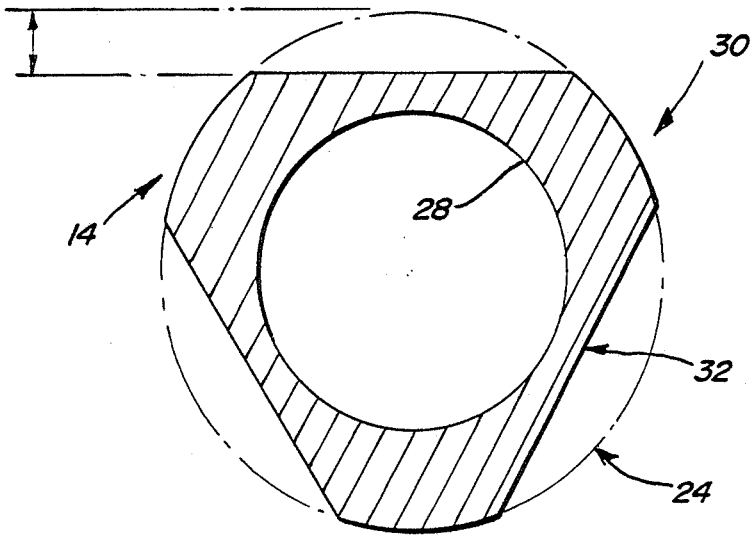
FIG. 4 is a cross-sectional view taken on line 4—4 of FIG. 3.

The various parts of the invention member 14 shown in FIGS. 3 and 4 are indicated in FIG. 2 by the same reference numeral followed by "A".

Members 14 and 14A are similar to each other in all respects except as to the manner in which the spiraling was done, as is clear from FIGS. 2 and 3. Both members 14 and 14A were approximately 15 feet in length, they were both turned down from a drill collar (the same starting drill collar was used in both cases), and each was provided with a box end tool joint 16 and 16A and with a pin end tool joint 18 and 18A. These tool joint ends 16 and 18 are conventional with the exception that they are shorter than ordinary new tool joints. Except for their shortness, the joints 16 and 18 are standard, the male end 18, called the pin, is screwed into the female end 16, called the box, to join the drill string members together end to end to make up any desired length of drill string member. The joints 16 and 18 will mate with similar tool joints on all other conventional members so that the invention member will cooperate with all standard drill string members and equipment of all sorts.

The version of FIG. 2 had a series of relatively short spiraled sections 20 separated by turned down, thinner sections 22. The sections 22 were turned down to the maximum thinness of the pipe which it is anticipated would still be usable. The invention version 14 of FIG. 3 is spiraled over its entire length.

The invention drill string member 14 of FIGS. 3 and 4 is provided with three spiral grooves 24, and these grooves go through transition zones 26 wherein they join to the tool joint portions 16 and 18. FIGS. 5 and 6 show the transition zones more clearly.

The 14A version made up of the alternating relatively short, thick spiraled sections 20 and thinner, turned down sections 22 had an overall weight less than that of the invention member 14 of FIGS. 3 and 4. Nevertheless, despite this advantage of reduced weight, the invention member 14, spiraled over its entire length, was found after testing to be more flexible than the version of FIG. 14A. It is not quite understood how or why that should have occurred. It is thought that perhaps with the alternating thicker and thinner sections 20 and 22 the plurality of transition zones which had to result had a detrimental effect on flexibility.

Referring now to FIG. 4, a cross section through the invention member 14 is shown. It can be seen that member 14 is defined by an inside diameter 28 and an outside diameter 30. The spiral grooves 24, three in the preferred embodiment, are provided. The phantom lines illustrate the outside diameter 30 before the grooves were cut away. The solid line remaining parts are called lands, and these are the parts of the member 14 which contact the borehole 10 in use.

FIG. 4 also shows the surface 32 defined by the bottoms of the spiral grooves 24. As discussed above, the present invention drill string members are designed for rigorous use in directional and deviated drilling situations, and thus are subjected to enormous stresses made up of combinations of torsion, compression, bending, tension, and bursting pressure from the pressure of the drilling fluid carried inside the drill string.

Combination cyclic stresses have been found to be highest at the bottom of the groove, and since the thinnest part of the invention member is at the bottom of the spiral grooves 24, it is anticipated that this is the zone which is most critical.

In order to prolong the useful life of the invention member, an optional feature is the application of a compressive prestress at the bottom of the groove in the surfaces 32. This will be explained in more detail below with regard to FIG. 8. In any event, treating, or more accurately pre-treating, the surfaces 32 has this desired effect. The surfaces 32, but not necessarily the lands remaining there between on the outside diameter 30, may be treated by shot peening or other equivalent means. This subjects the surfaces 32 to a prestress in the nature of a compression. Shot peening is not the only manner in which such a compression prestress can be applied to the surfaces 32. Alternative ways include heat treating, which has the effect of hardening the surface 32 at the bottom of the groove. Hardened surfaces have a better response as to tensile load, in effect, they act like a compressive prestress force in the invention. Another alternative is carburization, which involves creating a kind of surface alloy, and this will have the same effect as heat treating. However, it is presently thought that shot peening is probably the most efficient and most economical manner by which to create a compressive prestress at the surfaces 32.

It is anticipated that such a compressive prestress will have an extraordinary beneficial effect on useful life. More specifically, theories indicate that the useful life of an invention member with the addition of this compressive prestress at the surfaces 32 at the bottom of the grooves 24 will increase the useful life of the invention member by a factor of 4. That is, if an invention member without the surface treatment would have a certain number of endurance life cycles, it is anticipated it would have four times that many endurance life cycles with such surface treatment. Further, it is anticipated that such surface treatments of the grooves will not have any detrimental effect on the limberness or any other performance characteristic of invention members so treated.

When the prestress is applied to the grooves; it is possible the lands will also become at least partially prestressed. Such a prestress in the lands; it is thought, will neither hurt nor help the performance of the invention member. Thus, the invention includes such a prestress applied to both the lands and the grooves. It may be that so applying the pre-stress to the invention member in both the lands and the grooves, among other advantages, facilities the pre-stressing operation.

Referring now to FIGS. 5 and 6, the transition zones between the body of the spiraled member 14 of the invention and the tool joint end 16 is shown in detail. A similar situation exists at the other end as to the joint 18.

Overall, it is the intent of this portion of the invention to provide as smooth a transition as possible of the ends of the spiraled grooves 24 "feathering" into the tool joints 16 and 18. The purpose of this is to provide a uniform area for the change of stress from the thicker tool joint portion to the thinner main body portion. It has been found that this smooth transition through the transition portions 26 results in improved flexibility and overall performance for the invention member.

It is believed that three such spiral grooves 24 are optimal. As will be clear from the discussion of FIGS. 8–11 below, the number of flights of the spiral groove has an effect on performance. In only one groove were provided, it would have to have such a small pitch that the desirable stress relationships would be thrown off. Two spirals would produce irregular cross sections or cross sections with overly large lands. Four spirals would produce a square cross section, and would require cutting down land width to get a sufficiently thin wall at the bottom of the spirals. For reasons discussed immediately below, a square cross section is not desirable. It is necessary to have a certain minimum dimension across the lands for proper drilling. Beyond four spirals, five or six or even more might be workable, and especially multiples of three spirals might be workable, although this might produce problems of insufficient land width. Therefore, for all of these reasons, three spirals presently appears to be the optimum for the invention member 14.

Another way of looking at the optimal quality of three spirals is that in the preferred version having three grooves, the given force required to produce a given deflection of the member 14 will always be the same whatever the orientation of the member 14 about its own axis, i.e., whether there is a land facing up to the force or a flat facing up to the force. With four or any multiple of two spiral grooves, the cross-sectional shape at any transverse plane is necessarily symmetrical. Thus, if one were working against lands, the force required to produce a given deflection would be considerably greater than the force required to produce that same deflection if one happened to be working against grooves. The invention thus produces a uniformity of bending force, which is highly desirable, and that is part of the reason for the present preference for three spiral grooves.

However, additioal testing may be done, and it may be for various other reasons that any number of spiral grooves is operable with the invention.

Figure 7:
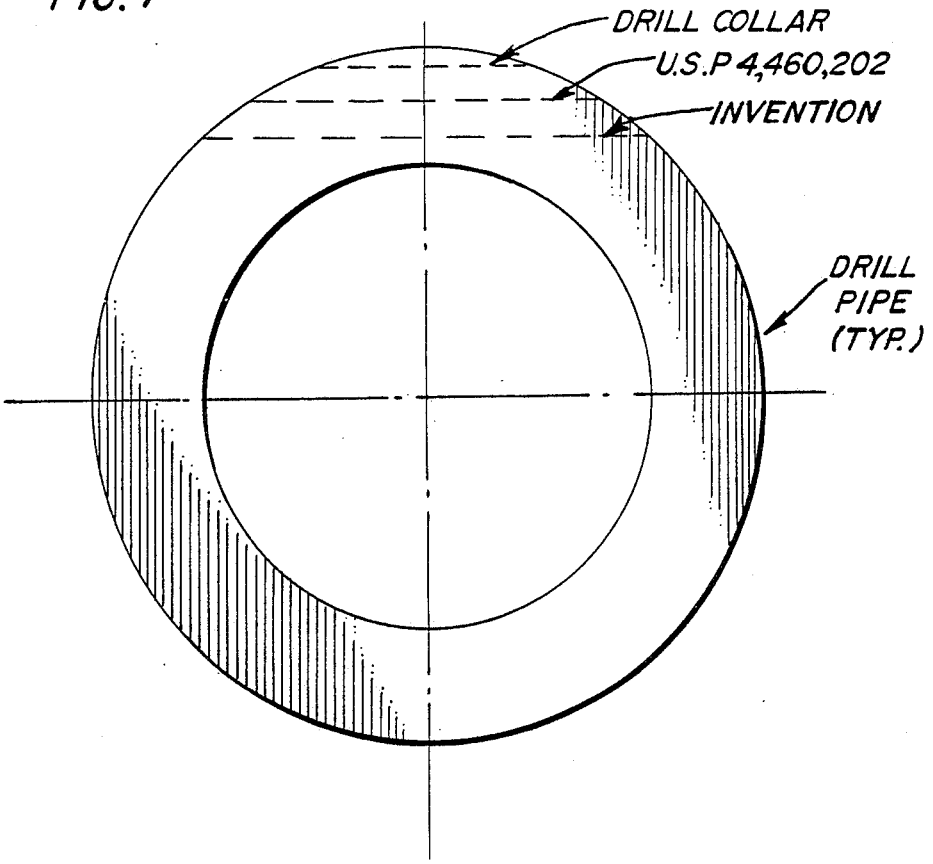
FIG. 7 is an imaginary cross-sectional view generally similar to FIG. 4 and illustrating the depth of cut engineering concepts involved in the spiral grooves.

FIG. 7 shows another aspect of the invention, namely, the depth of the spiral grooves 24. Basically, following the engineering concept of the invention to design the member 14 to perform at the maximum limits of its properties, the spiral groove 24 is to be as deep as possible while at the same time producing a drill string member having an acceptable minimum number of endurance cycles. This depth will be at least 40% of the wall thickness of the body measured from the land O.D. to the member's I.D., and preferably in the range of 55% to 85% thereof.

FIG. 7 and the numerical presentation associated with it are believed to be self-explanatory. The 0% figure associated with drill pipe is provided because it is unusual to spiral drill pipe since it is already a relatively thin walled member. Drill pipe is sued as the example in order to more dramatically show the different depths of grooving of the different members in FIG. 7.

Considerable development work and testing preceded bringing the invention to its present status as shown in FIG. 3. These data have been distilled into FIGS. 8–11 and the tables of information below. These drawings and tables illustrate the various features of the invention, their advantages over the prior art, and the like.

Table 1 below correlates a great deal of this test data and other data extrapolated therefrom, based upon tests performed in developing the invention.

TABLE 1

PROJECTED FATIGUE LIFE vs VARIOUS FACTORS
Based on 40 RPM, 36" Pitch, 3 Spirals, 15' Length

| (1) RADIUS (FT) | (2) RATE OF PENETRATION | (3) STRESS (PSI) | (4) WELL CYCLES | (5) ENDURANCE CYCLES | (6) NUMBER OF WELLS |
|---|---|---|---|---|---|
| 120 | 20 | 30417 | 22620 | 48727402 | 2154 |
| 110 | 20 | 33182 | 20735 | 16421629 | 792 |
| 100 | 20 | 36500 | 18850 | 4988933 | 265 |
| 90 | 20 | 40556 | 16965 | 1336716 | 79 |
| 80 | 20 | 45625 | 15080 | 306643 | 20 |
| 70 | 20 | 52143 | 13195 | 57774 | 4 |
| 60 | 20 | 60833 | 11310 | 8412 | 1 |
| 50 | 20 | 73000 | 9425 | 861 | 0 |
| 120 | 15 | 30417 | 30160 | 48727402 | 1616 |
| 110 | 15 | 33182 | 27647 | 16421629 | 594 |
| 100 | 15 | 36500 | 25133 | 4988933 | 198 |
| 90 | 15 | 40556 | 22620 | 1336716 | 59 |
| 80 | 15 | 45625 | 20107 | 306643 | 15 |
| 70 | 15 | 52143 | 17593 | 57774 | 3 |
| 60 | 15 | 60833 | 15080 | 8412 | 1 |
| 50 | 15 | 73000 | 12567 | 861 | 0 |
| 120 | 10 | 30417 | 45240 | 48727402 | 1077 |
| 110 | 10 | 33182 | 41470 | 16421629 | 396 |
| 100 | 10 | 36500 | 37700 | 4988933 | 132 |
| 90 | 10 | 40556 | 33930 | 1336716 | 39 |
| 80 | 10 | 45625 | 30160 | 306643 | 10 |
| 70 | 10 | 52143 | 26390 | 57774 | 2 |
| 60 | 10 | 60833 | 22620 | 8412 | 0 |
| 50 | 10 | 73000 | 18850 | 861 | 0 |
| 120 | 5 | 30417 | 90480 | 48727402 | 539 |
| 110 | 5 | 33182 | 82940 | 16421629 | 198 |
| 100 | 5 | 36500 | 75400 | 4988933 | 66 |
| 90 | 5 | 40556 | 67860 | 1336716 | 20 |
| 80 | 5 | 45625 | 60320 | 306643 | 5 |
| 70 | 5 | 52143 | 52780 | 57774 | 1 |
| 60 | 5 | 60833 | 45240 | 8412 | 0 |
| 50 | 5 | 73000 | 37700 | 861 | 0 |

Columns 1 and 2 are variable parameters selected by the user. Column 3 shows actual measured values based on tests performed in developing and improving the invention. Columns 4, 5, and 6 are calculated based on the first three columns. Particular attention is invented to the fifth column, "endurance cycles," as this is the measure of life with which those skilled in the art are most familiar. The sixth column, "number of wells," has been calculated as a convenience and correlates directly numerically to "endurance cycles," the endurance cycle data simply being divided by a constant to product "number of wells."

It is assumed in Table 1 that a well is being drilled in the configuration of FIG. 1, that is from vertical to horizontal, around the particular radius as stated, out some relatively short distance after the bend, and then drilling is stopped. As a result of this, the total feet of well drilled will be longer for the longer radii than for the shorter radii. However, this is deemed to be insignificant because the stress produced when rotating in the bend and not when drilling in a straight direction is deemed the destructive factor for the invention drill string member. The total length drilled has an effect on the bit itself, but that is not a primary consideration of the present invention.

The second column, "rate of penetration," accommodates different formations, different bit weights, and other factors well known to those skilled in the art. In summary, on occasion one drills fast and at other times one drills relatively slower, and this column accommodates that reality. As shown in Table 1, all of the data for the entire table is based on 40 rpm. Forty rpm is a practical speed with which the invention can be used for reasons discussed more in detail below, and that is the reason for the selection of the value for Table 1 and FIG. 8. As is known, of course, the speed of drilling is a function of both the actual feet of penetration per hour as well as of rpm. Likewise, the number of cycles of stress is a function of both rpm as well as rate of penetration. For purposes of the invention, the greater speed is desirable. The faster the well is drilled, the faster the bit rotates. The faster each drill string member according to the invention progresses through the bend, the fewer cycles of stress on each such member. The reduced stress increases the productive life of invention members. The rpm of the bit, in downhole motor driven drilling, is different from the rpm of the drill string. For purposes of the invention, it is only the rotational cycles of the drill string in the bend which is important. This is also true in directional applications where downhole motors are not used.

Drill string members built in accordance with the invention will be more expensive than comparable drill pipe. An advantage of the invention, however, in this regard, is that invention members do not need to be used during the vertical run of the well but only around the bend and in the horizontal run. Thus, in the example of FIG. 1, the hole could be any depth below the surface, but the length of invention drill string members will be equal to approximately 500 feet plus the distance required to go through the bend. This is so because when a downhole motor driven bit is going around a bend, it is usually required that the drill string not rotate at all. When such downhole motor driven bits are drilling in a straight direction, vertically, horizontally, or at any angle, then they require that the drill string rotate. Therefore, having completed the bend, a length of drill string made up of the invention members equal to the run of the non-vertical part of the well is required.

The rate of rotation of the drill string should be as low as possible. Forty rpm is the usual slowest speed at which the surface equipment can rotate the drill string. It is for that reason that this value was selected as the standard for Column 2 in Table 1.

Figure 8:
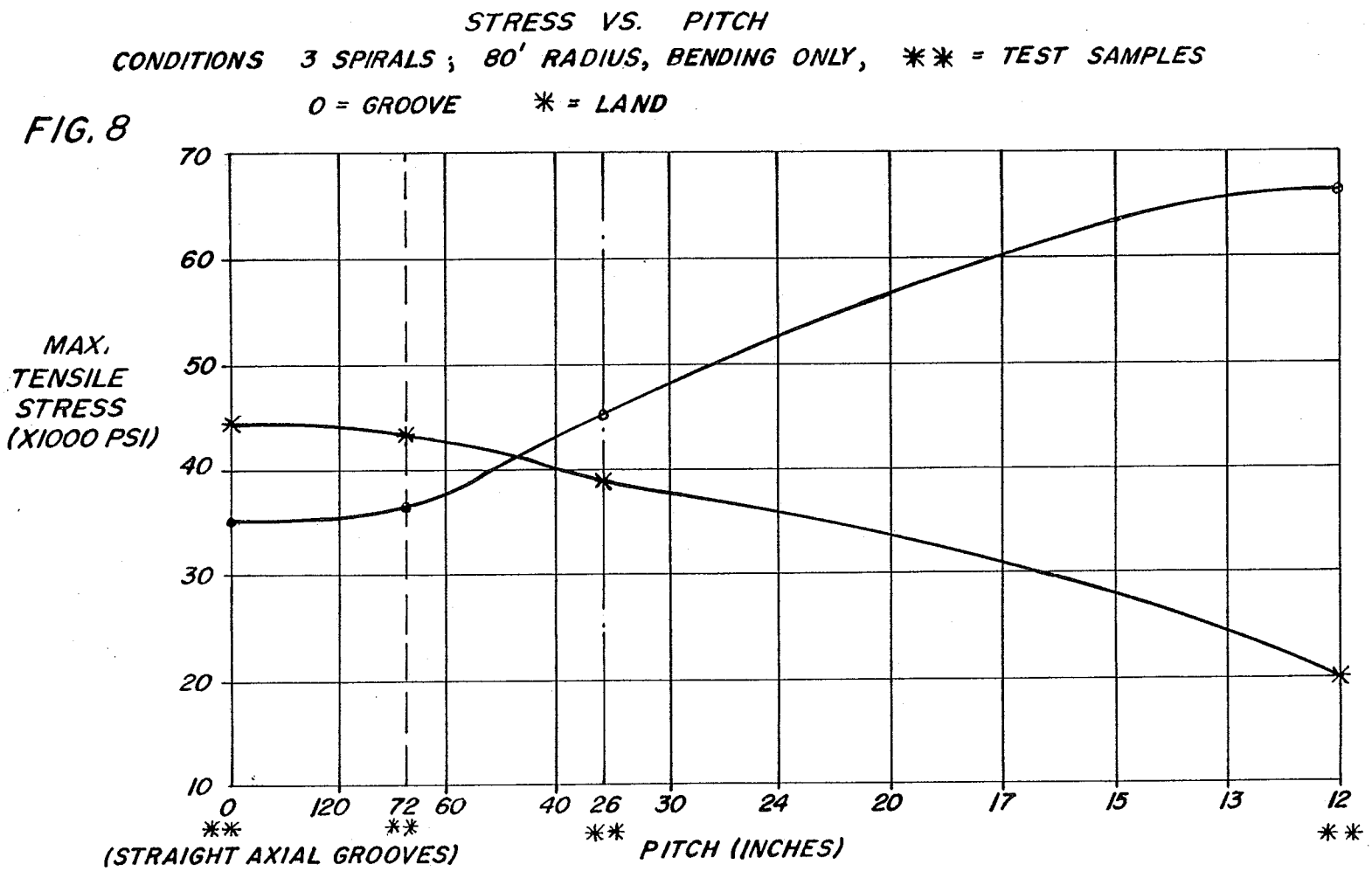

FIG. 8 is a set of two curves based in part on the 80-foot radius test data. The curve defined by the data indicated by circles shows the stress measured in the grooves of the test sample, and the companion curve indicated by stars indicates the measured stress on the lands. The X-axis indicates different pitches that were used for the test samples. The double star indicates actual tested values; all other values are extrapolated.

It is desired to select manufacture points to the right of the crossover point of the two curves shown in FIG. 8. Since the lands between the grooves wear in use, by selecting operating points to the right of the crossover, allowance for this wear will be made. That is, as the lands wear, the operating point of the invention drill string member, which could be represented by an imaginary vertical line, will move to the left of the original selected point--that is, towards the crossover point. The situation is similar to one wherein a family buys trousers for a young growing boy that are slightly longer then what he needs at the time the trousers are purchased. This allows room for the boy to "grow into" such trousers. This is exactly the thinking in selecting physical characteristics in designing invention members. Thus, by choosing points to the right of the crossover, the designer will allow for wear on the lands while maintaining the desirable stress relationship for as long as possible.

As discussed above, an optional feature of the invention is applying a pre-treatment to the bottoms of the spiral grooves in the nature of the compressive prestress. This has the effect of moving the crossing point to the right, which has exactly the same effect as that discussed above in initially selecting physical characteristics for invention members. Looking at it another way, such surface treatments have the effect of moving the curve for the stress in the groove (the curve indicated by the circles) downwardly on FIG. 8, thus moving the crossover point in effect to the right.

Other tables of data and curves such as Table 1 and FIG. 8 and the other figures and tables will be generated if other materials are used. All of the testing done for the invention and going into this data is based on ordinary grades of steel as are used in oil field tubular goods. Because of the requirements of MWD techniques, nonmagnetic stainless steel, copper, Monel, and other materials could also be used. The teaching of the invention can be applied based on the disclosure herein to such other materials by those skilled in the art.

It is currently believed that the invention will function properly whenever the difference between the maximum stress in the land and the maximum stress in the groove is equal to or less than 43,000 psi. By way of example, referring to FIG. 8, this would include all portions of the curve from the left extremity of the drawing to a point defined between the two pitches of 15 and 13 inches.

Table 2 illustrates the acceptable minimum size at the thinnest portion at the bottom of the spiral grooves for three different sizes of invention drill string member. Other sizes are contemplated for the future, but these are currently the most popular ones first contemplated for manufacture and commercialization.

TABLE 2

| CONNECTION | JOINT O.D. | JOINT I.D. | TUBE O.D. | TUBE I.D. | MINIMUM WALL | MINIMUM BEND RADIUS (FEET) | PREFERRED HOLE SIZES |
|---|---|---|---|---|---|---|---|
| 2⅞ | 3¾ | 2⅛ | 3½ | 2⅛ | 5/32 | 80 | 4¾–6¼ |
| 3½ | 4¾ | 2½ | 4¼ | 2½ | ¼ | 105 | 6½–6¾ |
| 4 | 6¼ | 2 13/16 | 5 | 2 13/16 | 5/16 | 125 | 7⅞–8¾ |

Based on groove depth = 72% of the wall thickness of the body from the land O.D. to the member's I.D.
All dimensions in inches unless otherwise indicated.

Figure 9:
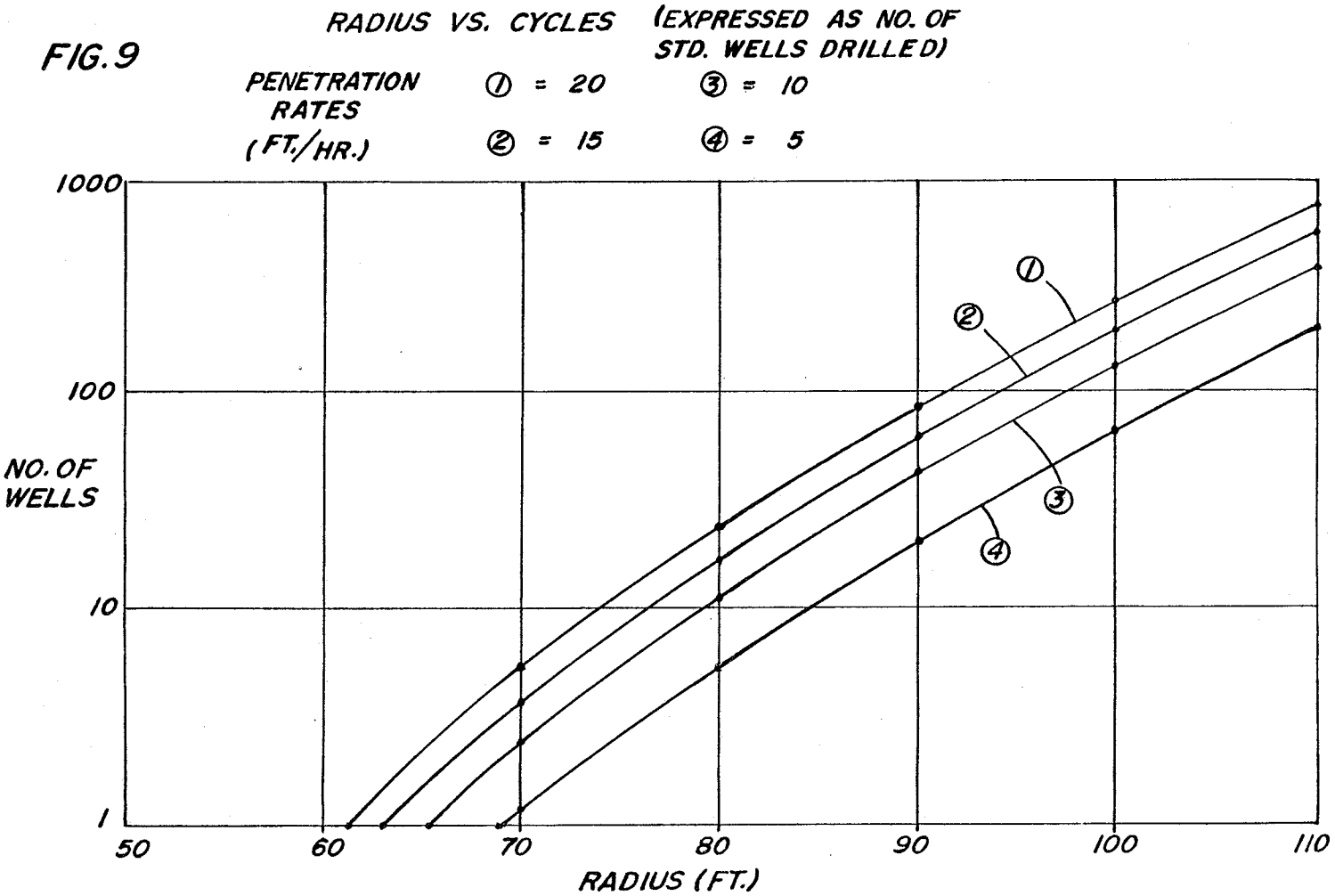

FIG. 9 is representative of a relatively large family of curves that could be drawn in a similar fashion from the data in Table 1.

FIG. 9 shows that the useful life increases in a logarithmic manner as the penetration rate goes up. The same effect occurs in regard to different radii. The radii changes produce an even more dramatic effect, and in fact, are more important commercially. For example, considering the relatively high speed 20-feet-per-hour penetration rate at the 70-foot radius, only about 8 standard wells would be expected. However, if the radius were increased to 90 feet, a more than 10 times increase in life would be achieved since the number of wells would then be equal to approximately 100.

As explained above, this "standard wells" parameter is merely a convenience; it can be as well expressed in cycles of endurance as indicated in Table 1.

The invention member is unique from the prior art in many ways as discussed above. Among these is the fact that it has a weight per unit length different from any other heretofore known type of oil field tubular goods. This point is illustrated in the following table.

TABLE 3

WEIGHT CHART

| NOMINAL SIZE | DRILL COLLARS | MEMBER PER USP 4,460,202 | INVENTION MEMBER | DRILL PIPE |
|---|---|---|---|---|
| 2⅜ | — | — | — | 6.65 |
| 2⅞ | 18.0 | — | — | 10.40 |
| 3¼ | 24.0 | — | 9.70 | — |
| 3½ | 28.5 | 28.3 | — | 13.30 |
| 4 | 37.0 | 33.8 | — | 14.00 |
| 4⅛ | 39.4 | — | — | — |
| 4¼ | 42.0 | — | 18.20 | — |
| 4½ | 46.0 | 44.0 | — | 16.60 |
| 4¾ | 49.6 | — | — | — |
| 5 | 51.0 | 55.3 | 25.50 | 19.50 |
| 5¼ | 53.4 | — | — | — |
| 5½ | 67.0 | 63.0 | — | 24.70 |
| 6¼ | 83.8 | — | — | — |
| 6½ | 92.8 | — | — | — |
| 7¼ | 11.6 | — | — | — |

The following table illustrates the advantages of the invention from a commercial acceptability point of view based on various performance characteristics. Of course the first one "flexibility" is the important one as far as the drilling of deviated holes on short radii, as discussed in detail above.

TABLE 4

Legends:
A = Acceptable
UA — Unacceptable

| MECHANICAL PROPERTY | THIN WALL TUBE* | INVENTION | THICK-WALL TUBE** |
|---|---|---|---|
| Flexibility | A | A | UA |
| Tensile Load Capacity | UA | A | A |
| Torsional Load Capacity | A | A | A |
| Burst Pressure | A | A | A |
| Stiffness Ratio | 1.3 to 1 | 1 | 1.3 to 1 |

*same I.D. and minimum wall as invention
**same O.D. and I.D. as invention

Figure 10:
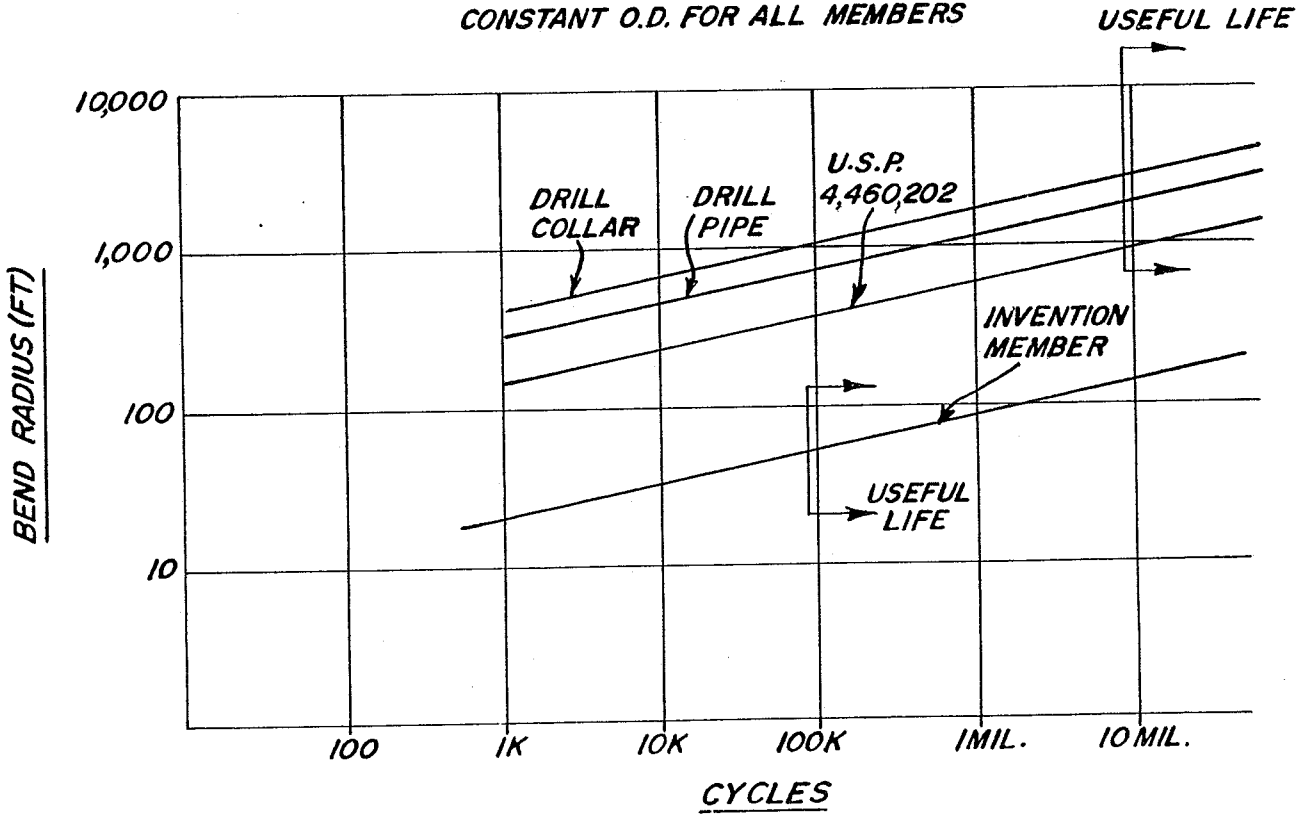

FIG. 10 is a summary type of curve illustrating the facet of the invention of designing it to the maximum of its mechanical properties. Note the lines marked "useful life" for the invention member and for the prior art members, and the difference in the acceptable life cycles. The presentation of FIG. 10 is on logarithmic scales in both the X- and Y-directions.

FIG. 11 is similar to FIG. 10 in that it likewise demonstrates the designing "to the edge" facet of the invention, this time comparing bend radius to yield stress, the value "100" on the Y-axis corresponding to failure.

While the invention has been described in detail above, it is this detailed description is by way of examples only, and that within the spirit of the invention and the scope of the following claims.

We claim:

1. A drill string member for drilling deviated holes to be interposed in a drill string, said drill string having a downhole or bit end and a surface or upper end, said member being interposed between a downhole motor driven bit at said bit end and drill pipe at said upper end, said drill string member having a weight per unit length slightly more than that of said drill pipe, said drill string member comprising tool joint means at each end thereof and a main body portion there between, said main body portion of said drill string member being formed with at least one spiral groove extending over the entire length of said main body portion and covering substantially the entire distance on said member between said tool joint means, said spiral groove defining lands on said main body portion between the flights thereof and being formed in said main body portion such that the maximum depth of said spiral groove being in the range of about 55% to about 85% of the wall thickness of the body measured from the O.D. of said land to the I.D. of said member, and said drill string member being made in such a way that the difference in the maximum stress in said lands and in said groove produced in said member due to bending loads produced during drilling said deviated holes is equal to or less than 43,000 psi.

2. The drill string member of claim 1, and said grooves and/or lands being provided with a compressive prestress therein.

3. The drill string member of claim 1, the number of said at least one spiral groove being equal to a whole integer multiple of three such spiral grooves.

4. The drill string member of claim 1, the ends of said at least one spiral groove being smoothly feathered to said tool joint portions.

5. The drill string member of claim 1, said drill string member being formed of ferrous material.

6. The drill string member of claim 5, said drill string member being formed of a material selected from the group comprising nonmagnetic stainless steel, copper, and Monel.

7. A method of assemblying a drill string for drilling deviated holes comprising the steps of providing a drill string member, interposing said drill string member in the drill string, said drill string having a downhole or bit end and a surface or upper end, said member being interposed between a downhole motor driven bit at said bit end of said drill string and drill pipe at said upper end of said drill string, providing said drill string member with a weight per unit length slightly more than that of said drill pipe, providing said drill string member with tool joint means at each end thereof and with a main body portion there between, providing said main body portion of said drill string member with at least one spiral groove extending over the entire length of said main body portion and covering substantially the entire distance on said member between said tool joint means, configuring said spiral groove so as to define lands on said main body portion between the flights thereof, forming said at least one spiral groove in said main body portion such that the maximum depth of said spiral groove being in the range of about 55% to about 85% of the wall thickness of the body measured from the O.D. of said land to the I.D. of said member, and making said at least one spiral groove and said drill string member such that the difference in the maximum stress in said lands and in said groove produced in said member due to bending loads produced during drilling said deviated holes is equal to or less than 43,000 psi.

8. The method of claim 7, and the step of providing said grooves and/or lands with a compressive prestress therein.

9. The method of claim 8, and the step of forming said compressive prestress by shot peening.

10. The method of claim 7 and the step of providing the number of said at least one spiral groove as a whole integer multiple of three such spiral grooves.

11. The method of claim 7, and the step of smoothly feathering the ends of said at least one spiral groove into said tool joint portions.

12. The method of claim 7, and the step of forming said drill string member of ferrous material.

13. The method of claim 7, and the step of using said drill string member together with measurement while drilling equipment and techniques.

14. The method of claim 13, and the step of forming said drill string member of non-ferrous a material selected from the group comprising nonmagnetic stainless steel, copper, and Monel.

* * * * *

UNITED STATES PATENT AND TRADEMARK OFFICE

CERTIFICATE OF CORRECTION

PATENT NO. : 4,811,800

DATED : March 14, 1989

INVENTOR(S) : Guy J. Hill, Homer G. Smith, Jr., Mark W. Schnitker, Glenn E. Beatty It is certified that error appears in the above-identified patent and that said Letters Patent is hereby corrected as shown below:

Claim 6, line 1, change "5" to --1--.

Claim 14, line 2, delete "non-ferrous".

Signed and Sealed this

Twenty-first Day of November, 1989

*Attest:*

JEFFREY M. SAMUELS

*Attesting Officer* *Acting Commissioner of Patents and Trademarks*